US007999749B2

(12) United States Patent
Ying

(10) Patent No.: US 7,999,749 B2
(45) Date of Patent: Aug. 16, 2011

(54) ANTENNA ASSEMBLY

(75) Inventor: Zhinong Ying, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 317 days.

(21) Appl. No.: 12/256,947

(22) Filed: Oct. 23, 2008

(65) Prior Publication Data

US 2010/0103052 A1 Apr. 29, 2010

(51) Int. Cl.
*H01Q 1/12* (2006.01)

(52) U.S. Cl. ..... 343/702; 343/700 MS; 343/876

(58) Field of Classification Search ..... 343/702, 343/846, 850, 876, 700 MS, 853
See application file for complete search history.

(56) References Cited

U.S. PATENT DOCUMENTS

| | | | | |
|---|---|---|---|---|
| 6,040,803 | A * | 3/2000 | Spall | 343/700 MS |
| 6,314,276 | B1 * | 11/2001 | Hilgers et al. | 455/575.7 |
| 6,452,565 | B1 * | 9/2002 | Kingsley et al. | 343/873 |
| 6,466,170 | B2 * | 10/2002 | Zhou | 343/700 MS |
| 6,483,463 | B2 | 11/2002 | Kadambi et al. | |
| 6,768,454 | B2 * | 7/2004 | Kingsley et al. | 342/368 |
| 7,071,879 | B2 * | 7/2006 | Strickland | 343/700 MS |
| 7,541,981 | B2 * | 6/2009 | Piskun | 343/700 MS |
| 7,843,396 | B2 * | 11/2010 | Hill et al. | 343/702 |
| 2004/0077379 | A1 | 4/2004 | Smith et al. | |
| 2008/0122703 | A1 * | 5/2008 | Ying | 343/702 |

FOREIGN PATENT DOCUMENTS

| | | | |
|---|---|---|---|
| EP | 1 798 811 | A1 | 6/2007 |
| GB | 2 388 963 | A | 11/2003 |
| JP | 60-047502 | | 3/1985 |
| WO | WO 02/058187 | A1 | 7/2002 |
| WO | WO 02/058190 | A1 | 7/2002 |
| WO | WO 03/098738 | A2 | 11/2003 |
| WO | WO 2007/147446 | A1 | 12/2007 |

OTHER PUBLICATIONS

PCT International Search Report and Written Opinion, corresponding to PCT/EP2009/054918, mailed Sep. 17, 2009.

* cited by examiner

*Primary Examiner* — Tho G Phan
(74) *Attorney, Agent, or Firm* — Harrity & Harrity, LLP

(57) ABSTRACT

An antenna assembly may include a carrying structure having a number of faces, each face having at least partly a ground plane and each face being provided with at least one dielectric resonator antenna (DRA) element. The antenna assembly may include a controller arrangement, a switching arrangement connected to each of said DRA elements, the controller arrangement being configured to switch the antenna elements and alter frequency, polarization and/or radiation pattern of each DRA element.

13 Claims, 6 Drawing Sheets

ANTENNA ASSEMBLY

TECHNICAL FIELD

The present invention generally relates to an antenna assembly and, more particularly, to a dielectric resonator antenna assembly.

BACKGROUND

An antenna is a transducer designed to transmit and/or receive radio, television, microwave, telephone, and/or radar signals, i.e., an antenna converts electrical currents of a particular frequency into electromagnetic waves and, vice versa. Physically, an antenna is an arrangement of one or more electrical conductors that is arranged to generate a radiating electromagnetic field in response to an applied alternating voltage and the associated alternating electric current, or that can be placed in an electromagnetic field so that the field will induce an alternating current in the antenna and a voltage between its terminals.

Portable wireless communication electronic devices, such as mobile phones, typically include an antenna that is connected to electrically conducting tracks or contacts on a printed wiring board using techniques such as soldering or welding. Manufacturers of such electronic devices are under constant pressure to reduce the physical size, weight, and cost of the devices and improve their electrical performance. Low cost requirements dictate that the electronic device and its antenna should be incomplex and inexpensive to manufacture, produce and/or assemble.

In recent years, a new type of antenna has evolved that is small and has a high radiation efficiency, and is therefore of interest for use in cellular phones. In a dielectric resonator antenna (DRA), a probe can excite a transmission mode in a resonating dielectric antenna volume.

Within the framework of the development of antennas associated with mass-market products and use in domestic wireless networks, antennas consisting of a dielectric resonator have been identified as an interesting and viable commercial solution. Specifically, antennas of this type exhibit good properties in terms of passband and radiation. Moreover, they readily take the form of discrete components that can be surface mounted. Components of this type are known by the term, SMC components. SMC components are of interest, in the field of wireless communications for the mass-market, since they allow the use of low-cost substrates, thereby leading to a reduction in costs while ensuring equipment integration. Moreover, when RF frequency functions are developed in the form of SMC components, good performance is obtained despite the low quality of the substrate and integration is often favored thereby.

Moreover, new requirements, in terms of throughput, are leading to the use of high-throughput cellular communication networks such as 0G, 1G, 2G, 3G, and 4G or multimedia networks such as Hyperlan2 and IEEE 802.11A networks. In this case, the antenna must be able to ensure operation over a wide frequency band. Currently, DRA consist of a dielectric patch of any shape, characterized by its relative permittivity. The passband is directly related to the dielectric constant which therefore conditions the size of the resonator. Thus, the lower the permittivity, the more wideband the DRA antenna, but in this case, the component is bulky. However, in the case of use in wireless communication networks, the compactness constraints demand a reduction in the size of dielectric resonator antennas, possibly leading to incompatibility with the bandwidths required for such applications.

A trend to enhance the wireless data rate, in which compact and channel uncorrelated antenna is vital for such systems, is MIMO (multi-input, multi-output) antenna system.

U.S. Patent Application Publication No. 2008/0122703, by the same inventor, incorporated in its entirety herein by reference, relates to a dielectric radiator antenna arrangement for a communication device having a ground plane. The antenna arrangement may include a dielectric volume having a central axis normal to the ground plane, and mode-exciting elements. The mode-exciting elements may include a first mode-exciting element provided in or attached to the dielectric volume and extending in a plane provided at a first distance from the central axis perpendicular to the ground plane, and a second mode-exciting element provided in or attached to the dielectric volume and extending in a plane provided at a second distance from the central axis and perpendicular to both the ground plane and the plane of the first mode-exciting element. The antenna arrangement can be used for simultaneously transmitting and receiving more than one signal at one frequency with reduced coupling.

SUMMARY

Embodiments of the present invention introduce a novel and advanced solution, which readily meets the requirements in high speed wireless communications.

Thus, by controlling a DRA antenna array in an intelligent and innovative way, the antenna may realize a number (e.g., 15) of independent MIMO channels with polarized, space, pattern diversity, beam form, high gain antenna system for high speed wireless communications.

Other advantages of the invention may include:

Diversity for weak S/N, strong fading

Spatial division multiple access (SDMA) for multi-users

MIMO for data rate, strong S/N, strong fading

Beam forming for weak S/N, weak fading

- Switched array
- Dynamically beam steering
- Adaptive arrays

These performance characteristics are achieved using an antenna assembly that includes a carrying structure having a number of faces, each face having at least partly a ground plane and each face being provided with at least one dielectric resonator antenna (DRA) element. The antenna assembly may include a controller arrangement, a switching arrangement connected to each of the DRA elements, the controller arrangement being configured to switch the antenna elements and alter one or several of frequency, polarization, and/or radiation pattern of each DRA element. For example, in the antenna assembly, each antenna element may include a dielectric volume having a central axis normal to the ground plane; and two or more mode-exciting elements, including, a first mode-exciting element provided in or attached to the dielectric volume and extending in a plane provided at a first distance from the central axis and being perpendicular to the ground plane, and a second mode-exciting element provided in or attached to the dielectric volume and extending in a plane provided at a second distance from the central axis and being perpendicular to both the ground plane and the plane of the first mode-exciting element. The antenna assembly may include a phase shifter, an adaptive matching circuit, an adder/weight controller, a sensor, a storage unit, a demodulator, and/or a passband processor. For example, the carrying structure may be cubic. The carrying structure may also be one and/or several of spherical, hemispherical, cylindrical, half-cylindrical, circular, half-circular, and/or pyramid shaped, combinations thereof, or any irregular shape.

The antenna assembly may be a part of one of a MIMO (Multi-Input, Multi-Output), MISO (Multi-Input, Single-Output), SIMO (Single-Input, Multi-Output) and/or SISO (Single-Input, Single-Output) antenna system.

Embodiments of the invention provide a communication device including an antenna arrangement including a carrying structure having a number of faces, each face having at least partly a ground plane, and each face being provided with at least one dielectric resonator antenna (DRA) element. The antenna assembly may include a controller arrangement, a switching arrangement connected to each of the DRA elements, the controller arrangement being configured to switch the antenna elements and alter one or several of frequency, polarization, and/or radiation pattern of each DRA element. The antenna element may include a dielectric volume having a central axis normal to the ground plane, and a number of mode-exciting elements, including, a first mode-exciting element provided in and/or attached to the dielectric volume and extending in a plane provided at a first distance from the central axis and being perpendicular to the ground plane, a second mode-exciting element provided in and/or attached to the dielectric volume and extending in a plane provided at a second distance from the central axis and being perpendicular to both the ground plane and the plane of the first mode-exciting element; and a separate signal feeder for each mode-exciting element.

In some embodiments, the communication device may include a portable communication device, for example, communication may be a cellular phone. The communication device may also be one of a base station, wireless routers/gateways, a communication card, a camera, a laptop, and/or a PDA.

Embodiments of the invention provide a method of enhancing at least one diversity for weak S/N, strong fading, spatial division multiple access (SDMA) for multi-users, MIMO for data rate, strong S/N, strong fading, beam forming for weak S/N, and/or weak fading, in a communication device. The method may include the steps of: providing at least one dielectric resonator antenna (DRA) element on a carrying structure having a number of faces, each face having at least partly a ground plane and each face being provided with, and using a controller arrangement and a switching arrangement connected to each of the DRA elements to switch the antenna elements and alter one or several of frequency, polarization, and/or radiation pattern of each DRA element.

BRIEF DESCRIPTION OF THE DRAWINGS

The present invention will now be described in more detail in relation to the enclosed drawings, in which.

DETAILED DESCRIPTION

Figure 1:
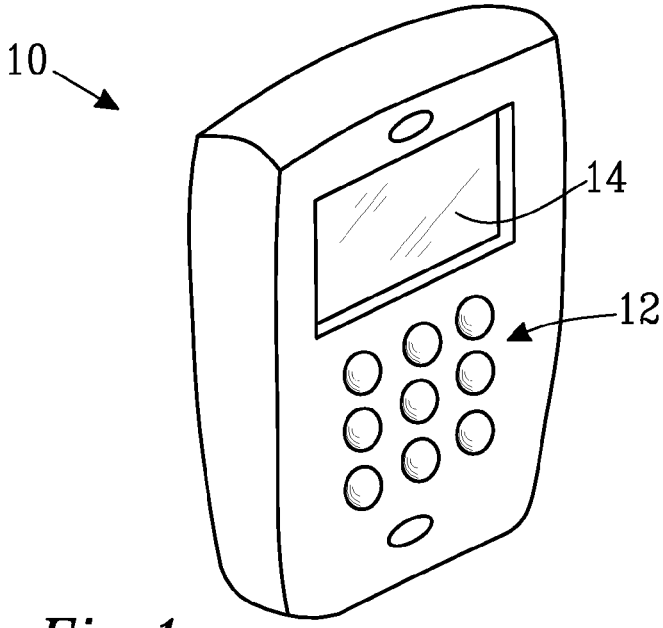
FIG. 1 shows a front view of a portable communication device in the form of a cellular phone.

In FIG. 1, a front view of a portable communication device, phone 10 in the form a cellular phone is illustrated. The different functional units of phone 10 may be provided inside a casing, which on a front side is provided with openings through which a display 14 and a keypad 12 are provided. Phone 10 furthermore may include at least one antenna arrangement, which according to an embodiment of the invention, may be provided in the interior of phone 10. A telephone is just one type of portable communication device where the invention may be implemented. Other examples include PDAs (personal digital assistants), laptop computers, etc. The invention is not limited to portable communication devices, but may be used in stationary communication devices, like for instance in base stations.

Figure 2:
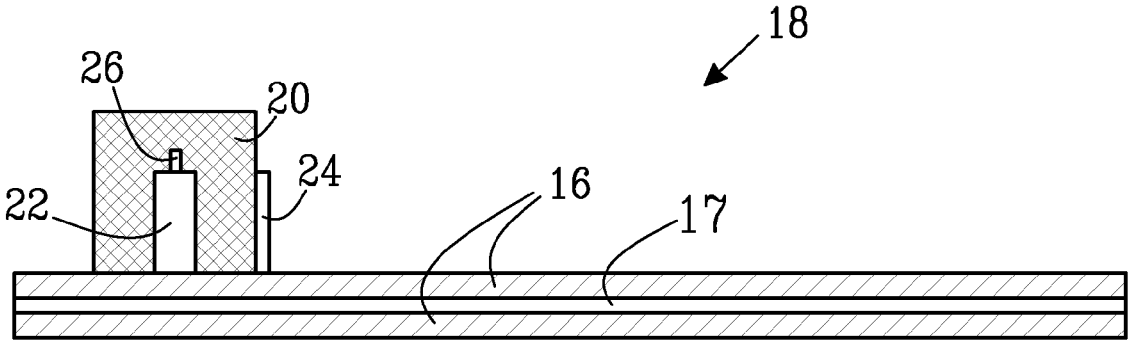
FIG. 2 schematically shows a side view of a dielectric resonator antenna arrangement according to prior art.

FIG. 2 shows a side view of an antenna arrangement 18 provided on a circuit board 16 comprising a ground plane 17. On board 16, a radio circuit (not shown) may be provided that may be arranged to feed the antenna with a number of signals, for example, three signals. The signals may furthermore have different frequencies and/or the same frequency. Antenna arrangement 18 may be arranged to also receive three signals over the air that may have the same (or differing) frequency and forward the received signals to the radio circuit for further processing. In this manner, antenna arrangement 18 may be provided for a MIMO system.

Antenna arrangement 18 may include a dielectric resonator antenna (DRA) and therefore may have a volume that in the present embodiment is a cubical volume, substantially filled with, for example, dielectric material 20. The volume may thus be a dielectric volume. The shape of the volume may be dimensioned for resonating at the above-mentioned frequency. Antenna arrangement 18 may include three (or more) mode exciting elements 22, 24, 26 arranged to excite three modes within the cube.

Figure 3:
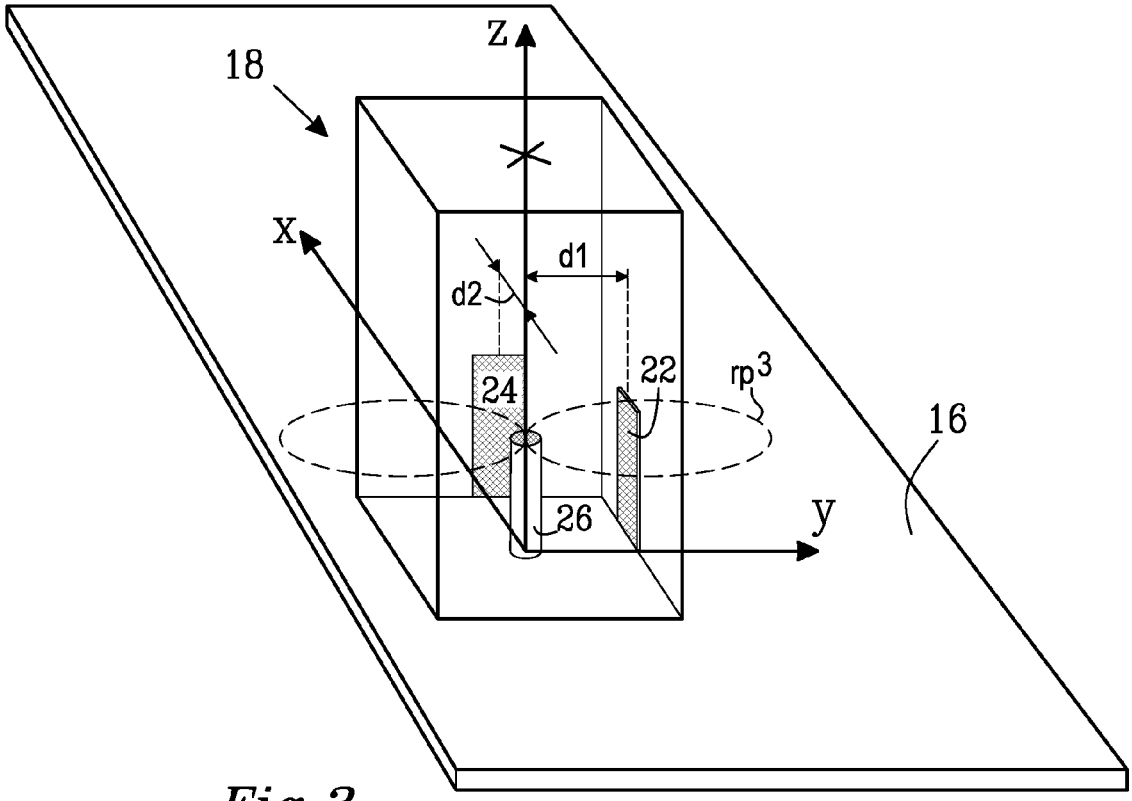
FIG. 3 shows a perspective view of the dielectric resonator antenna arrangement.
Figure 4:
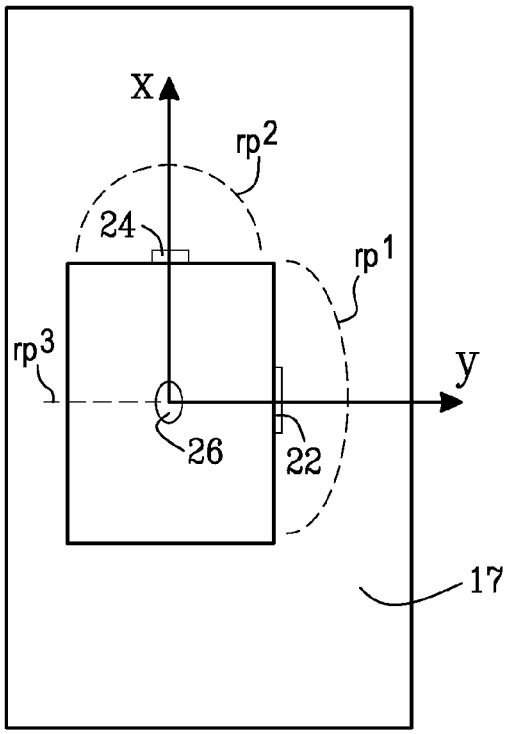
FIG. 4 shows a view from above of the dielectric resonator antenna arrangement of FIG. 3.

In FIG. 3, and also in a view from above (i.e., plan view) in FIG. 4, the structure is also shown in more detail in a perspective view. In relation to the cube, there is shown a three-dimensional coordinate system, with x-, y-, and z-axes, where the z-axis goes upwards from the middle of the cube at a bottom side of this cube that faces ground plane 17. The z-axis is thus a normal of ground plane 17 and, in this way, defines a central axis of the cube. The x-axis starts from the same point in the middle of the cube and continues in the middle between a right and a left bottom side of the cube and in parallel with these sides in a direction towards a far short side of ground plane 17 and thereby crosses a far bottom side of the cube at right angles. The y-axis starts from the same point in the middle of the cube in the middle and continues between a front bottom side and a back bottom side of the cube and in parallel with these sides in a direction towards a right long side of ground plane 27 and thereby crosses the right bottom side of the cube at right angles.

A first mode exciting element 22, in the form of a rectangular probe, for example, may be provided in a plane parallel to the xz-plane at a distance d1 from the central axis z and on a right vertical side of the cube at a bottom side thereof. The plane that first mode exciting element 22 may be provided in may also be perpendicular to ground plane 17. A second mode exciting element 24, in the form of a rectangular probe, for example, may be provided in a plane parallel to the xy-plane at a distance d2 from the central axis and on a far vertical side of the cube at a bottom side thereof. The plane that second mode exciting element 24 may be provided in may be perpendicular to ground plane 17 and also to the plane in which first mode exciting element 22 may be provided. Thus, first and second mode exciting elements 22, 24 may be provided adjacent the ground plane. A third mode exciting element 26, in the form of pin, for example, may extend from the bottom side of the cube that faces the ground plane 17 and along the z-axis, i.e., along the central axis. Each mode exciting element may connect to a separate signal feeder (not shown) of phone 10, and thus receive a separate signal. Two of the mode exciting elements may connect to a same signal feeder of phone 10, and thus receive the same signal, while the other mode exciting element may connect to a separate signal feeder of phone 10, and thus receive a separate signal.

Figure 5:
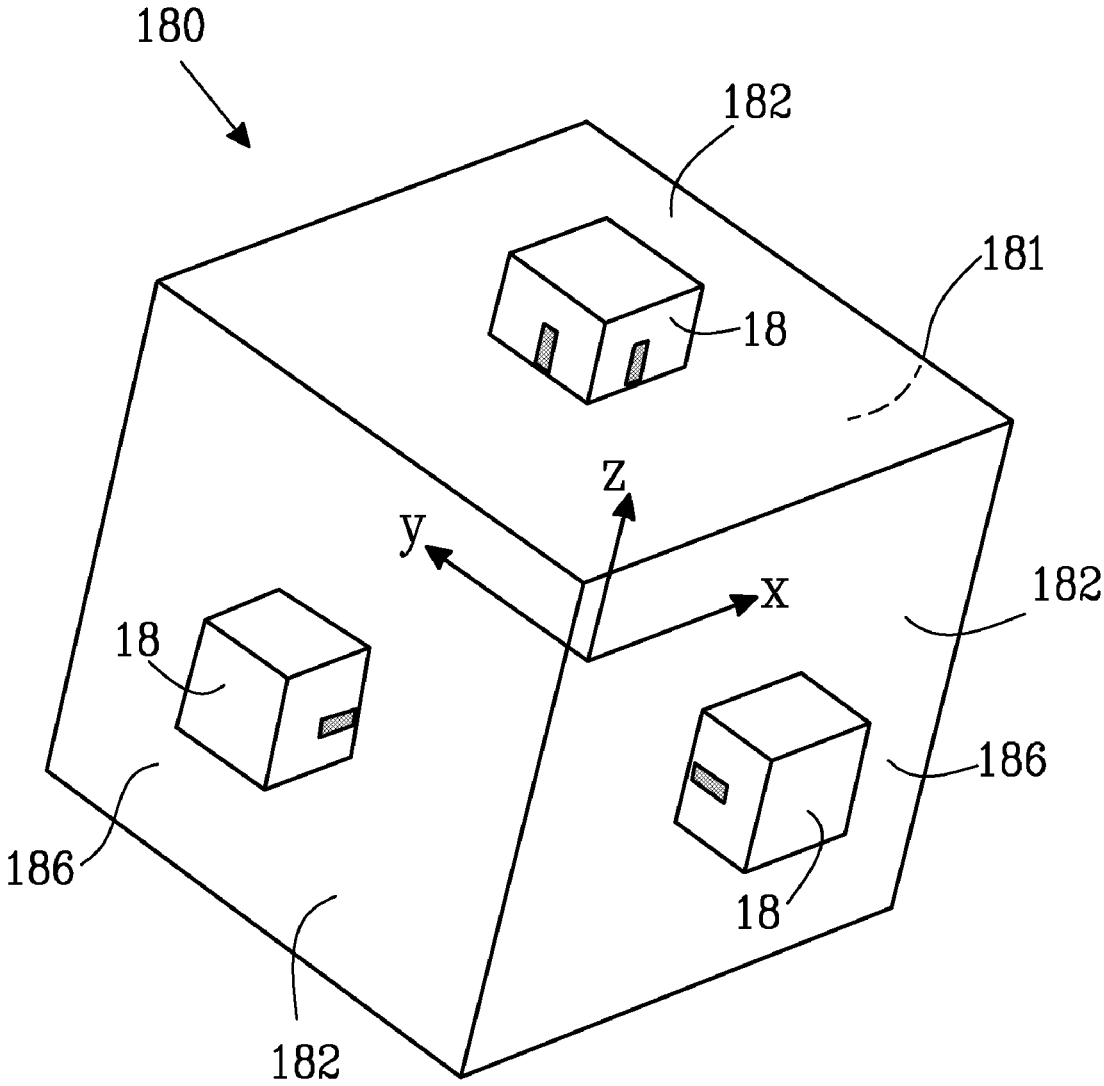
FIG. 5 shows a perspective view of the antenna assembly according to one implementation according to the present invention.

Antenna 180, according to one embodiment of the invention, is shown in FIG. 5 in a perspective view. Antenna 180 may include a carrying structure 181, for example, having a cubic volume. Each one of faces 182 of the carrying element may be provided with at least one antenna element 18, as described above. Each face 182 may include a circuit board 186 including a ground plane (not shown). Each board 186 may furthermore be provided with a radio circuit (not shown) arranged to feed each antenna element 18 with a number of signals, based on the number of mode exciting elements.

Figure 6:
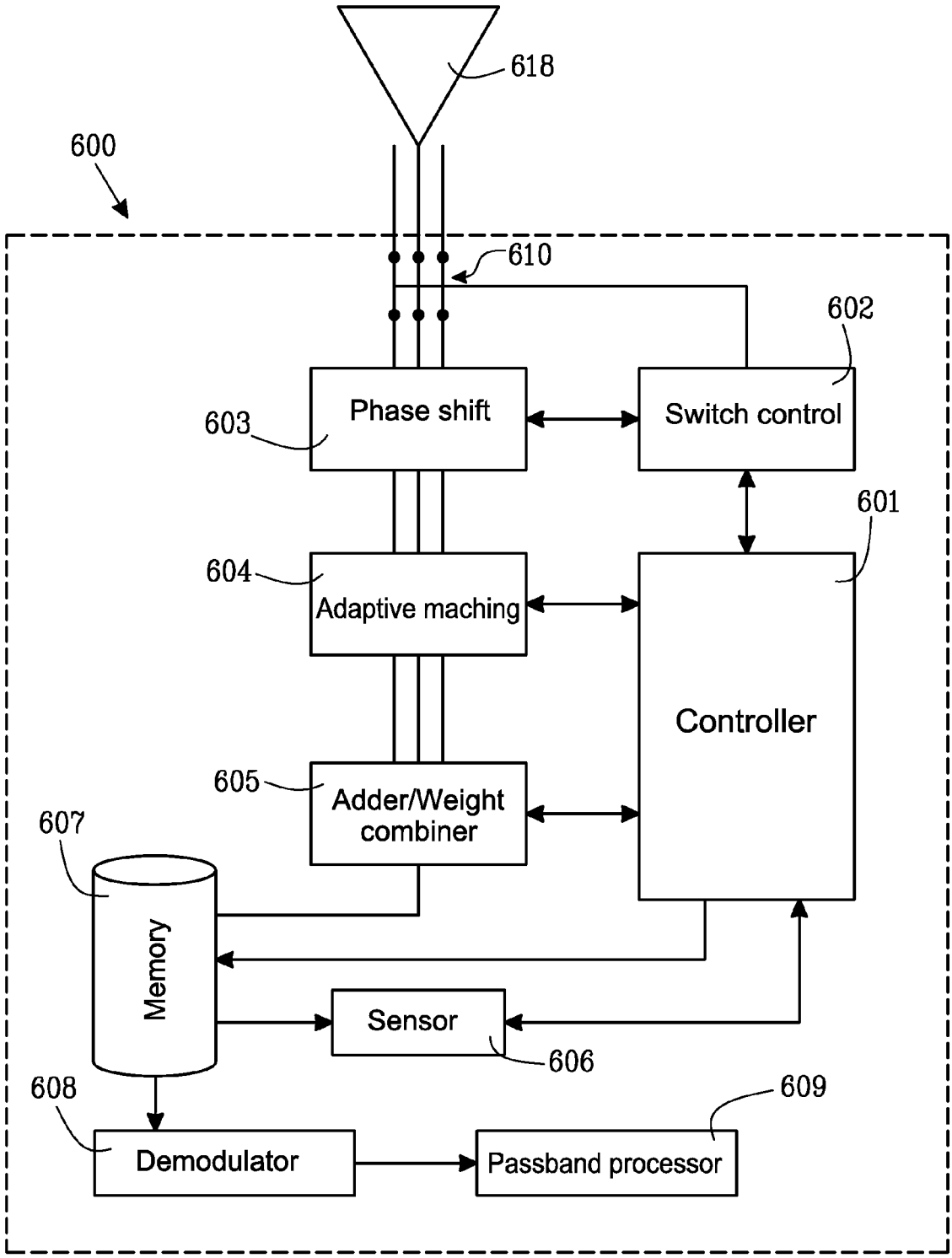
FIG. 6 is a schematic diagram of an antenna system according to the present invention.

FIG. 6 is a schematic diagram of an antenna system including an antenna element 618, as described above, and an antenna interface circuit 600. Antenna interface circuit 600 may include a controller 601, a switch controller 602, a phase shifter 603, an adaptive matching circuit 604, an adder/weight controller 605, a sensor 606, a storage unit 607, a demodulator 608, a passband processor 609, and/or switching elements 610. Phase shifter 603 and adaptive matching circuit 604 may be employed and/or connected for different applications.

The control portion may connect to an antenna element 618.

Phase shifter 603, which may change transmission phase angel, may connect to antenna element 618 and be controlled by switch controller 602. Adaptive matching circuit 604 may be controlled by control unit 601 and connect to antenna elements 618.

In FIG. 6, a number of antenna elements 618 (only one illustrated) may connect separately to phase shift circuit 603 and adaptive matching circuit 604. In the configuration shown in FIG. 2, the antenna may operate in a receive mode, but it will be clear that signals could instead be supplied to the antenna, in a transmit mode, for example, by reversing the direction of signal propagation arrows in FIG. 6. Adaptive matching circuit 604 may be under the control of controller 601.

Received signals from the adaptive matching circuit 604 may be supplied to the adder/weight combiner 605, which may combine the outputs of adaptive matching circuit 604 to form a composite signal. The composite signal may then be stored in a memory unit 607. A sensor 606 may examine the signal (e.g., the level of the signal to noise plus interference ratio) and pass the information to controller 601 which in turn may adjust the weighting factors, matching circuit 604, and switch elements 610 to improve and/or optimize the parameter sensed by sensor 606. The optimization information can be used to optimize and/or improve the quality of the stored signal, which may then be passed to demodulator 608. The information may also be used to adjust the antenna system to receive the next incoming signal.

The operations performed by switches 610 and the phase shifter under the control of switch controller 602, can change the response and/or radiation pattern of the antenna. These operations may be carried out under the control of controller 601 to improve and/or optimize operation with a particular signal frequency, polarization and direction of propagation. The radiation patterns (amplitude, phase, and/or polarization) of the antennas can be switched by the electrically controlled switching system and/or processed by a digital signal processing (DSP) system. In a mobile terminal, the space for the antenna may be limited; thus, this type of antenna may then be realized by using multiple antennas and/or a reconfigurable (e.g., deformable) antenna.

Figure 7:
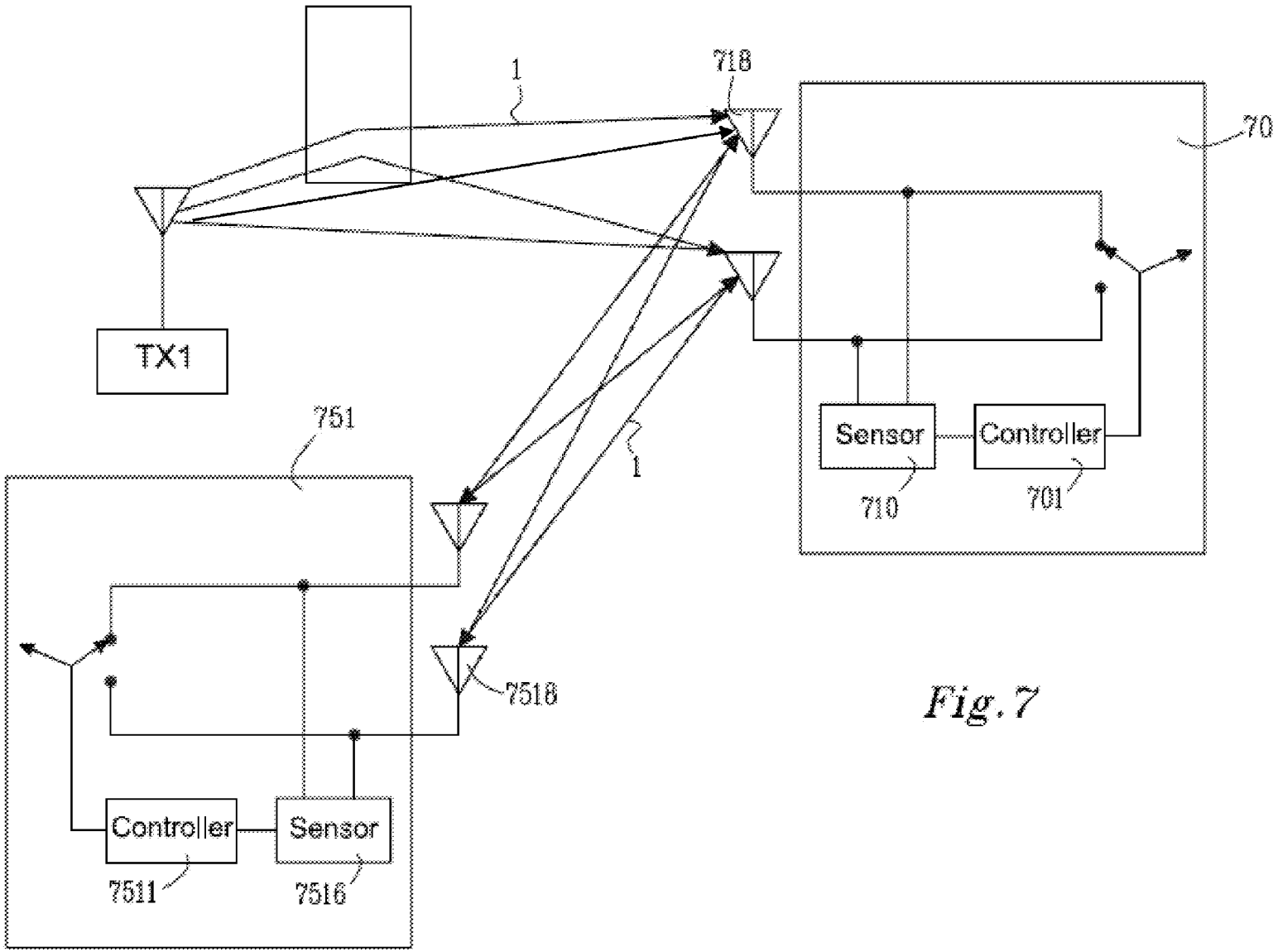
FIG. 7 is a schematic diagram of a part of an antenna system according to the present invention.

FIG. 7 illustrates an operational stage of a mobile terminal according to an embodiment of the invention. A first transmitter TX1 751 and a second transmitter TX2 752 may transmit radio signals 1, which may take a different path to a receiver 70 provided with an antenna arrangement according to the present invention. TX2 may be provided with MIMO antenna system. The radio signal may be received by antennas 718 (two in this example) and provided to a sensor 706 for detecting the signal strength. Based on the detected signal strength, a controller 701 may be switched between the two antennas for best available signal strength. This may provide diversity for weak Signal-Noise ratio and strong fading.

In a same way, in TX2 including antennas 7518, the radio signal may be received and provided to a sensor 7516 that may detect the signal strength. Based on the detected signal strength, controller 7511 may be switched between the two antennas for best available signal strength. This may provide diversity for weak Signal-Noise ratio and strong fading.

The antenna arrangement according to embodiments of the invention may offer, for example, 15 MIMO channels with compact size. The smart switching network, as described above, may allow the antenna to offer high gain with beam forming, space, polar, and/or space diversity features.

The isolation may be, for example, more than 15 dB. Thus, a very compact solution may be provided. Each single antenna may have, for example, +5 dBi antenna gain. With beam forming, higher gain can be achieved.

Thus, the antenna will be powerful, especially for high speed wireless communications.

The cubical volume, according to one aspect of the invention, may mean a three-dimensional object bounded by six square faces, facets or sides, with three meeting at each vertex.

The invention is not limited for use in cell phones. It may be advantageously used in any device for communication, such as a base station, wireless routers/gateways, communication cards, cameras, laptops, PDAs, etc.

Moreover, the antenna of the present invention may be used in other antenna configurations such as MISO (Multi-Input, Single-Output), SIMO (Single-Input, Multi-Output) or SISO (Single-Input, Single-Output).

In the described implementation, the volume may be provided in the form of a cube, both for the carrying structure and the antenna elements. It should be realized that the invention is in no way limited to a cube or any other particular shape. The volume may be spherical, hemispherical, cylindrical, half-cylindrical, circular, half-circular, pyramidal, a cuboid, and/or combinations of these shapes. The volume may be any type of regular or irregular shape. The mode-exciting elements have been described as provided on the outer side of the dielectric material; however, the mode-exciting elements may be provided inside the material as well, at a distance from the central axis and, for example, orthogonal to one another. The mode-exciting elements may then be provided in cavities provided in the dielectric material, for example. Other configurations are possible.

The mode-exciting elements may be provided by printing or painting metal, for example, on the dielectric material or by inserting metal elements in drilled holes in the dielectric material. Accordingly, it is furthermore possible to provide antenna arrangement as a single component, which may be a surface mount component. The component may be very small and thus may occupy limited space within a portable communication device. Such a component may be easily mass-produced and thus permits the provision of an inexpensive antenna arrangement. Since it is a component, it may be readily mounted to a circuit board, for example, or any other substrate.

Figure 8:
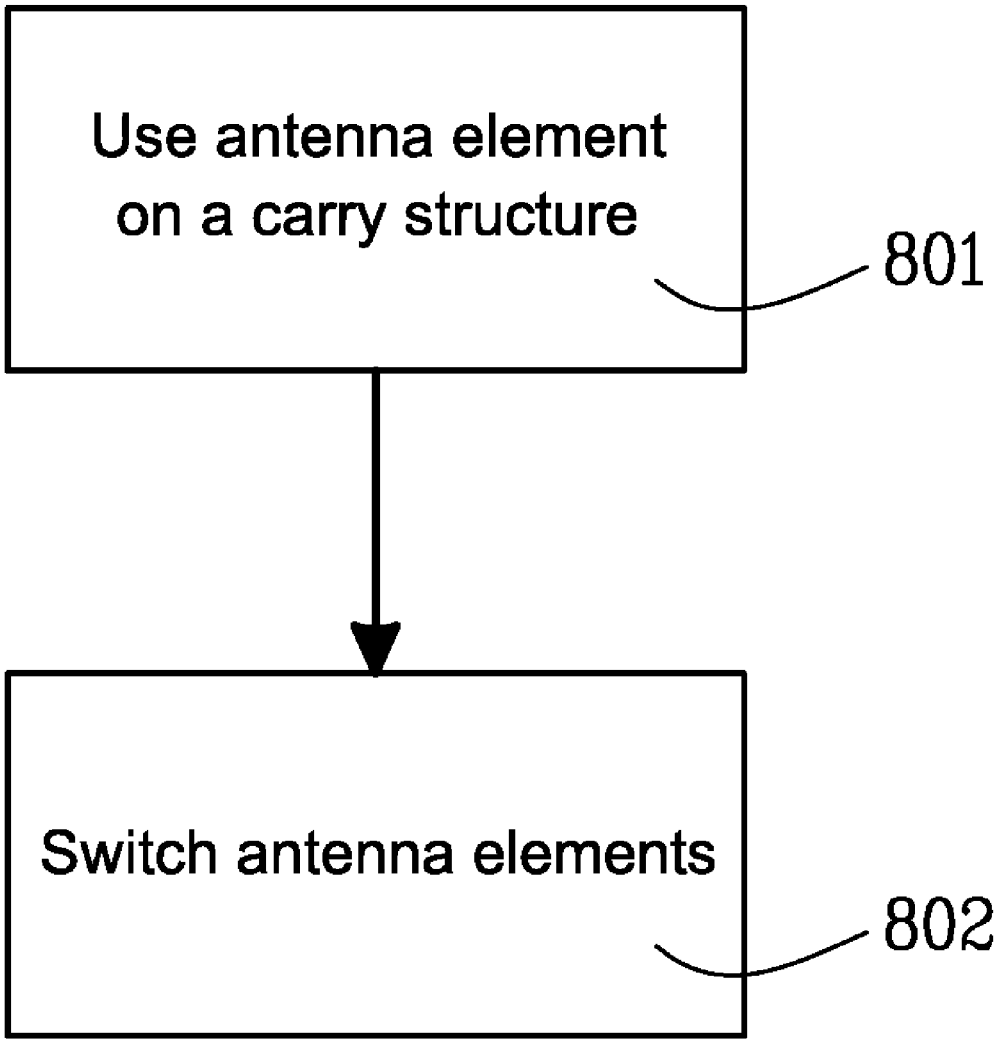
FIG. 8 is a flow diagram illustrating the method of the invention.

A method of the invention for enhancing at least one diversity for weak S/N, strong fading, spatial division multiple access (SDMA) for multi-users, MIMO for data rate, strong S/N, strong fading, beam forming for weak S/N, and/or weak fading, in a communication device, includes the steps of FIG. 8:

using 801 at least one dielectric resonator antenna (DRA) element on a carrying structure having a number of faces, each face having at least partly a ground plane and each face being provided therewith, by means of a controller arrangement and a switching arrangement connected to each of said DRA elements, switching 802 said antenna elements and altering one or several of frequency, polarization, and/or radiation pattern of each DRA element.

It should be noted that the word "comprising" does not exclude the presence of other elements or steps than those listed and the words "a" or "an" preceding an element do not exclude the presence of a plurality of such elements. It should further be noted that any reference signs do not limit the scope of the claims, that the invention may be implemented by means of both hardware and software, and that several "means" may be represented by the same item of hardware.

The above mentioned and described embodiments are only given as examples and should not be limiting to the present invention. Other solutions, uses, objectives, and functions within the scope of the invention as claimed in the below described patent claims should be apparent for the person skilled in the art.

I claim:

1. An antenna assembly comprising:

a carrying structure having a number of faces, each face having at least partly a ground plane and each face being provided with at least one dielectric resonator antenna (DRA) element;

a controller arrangement;

an adder/weight controller;

a sensor;

a demodulator; and a switching arrangement connected to each of the DRA elements, the controller arrangement to switch the antenna elements and alter at least one of frequency, polarization, or radiation pattern of each DRA element.

2. The antenna assembly of claim 1, wherein each antenna element comprises:

a dielectric volume having a central axis normal to the ground plane; and two or more mode-exciting elements, including, a first mode-exciting element provided in or attached to the dielectric volume and extending in a plane provided at a first distance from the central axis and being perpendicular to the ground plane, and a second mode-exciting element provided in or attached to the dielectric volume and extending in a plane provided at a second distance from the central axis and being perpendicular to both the ground plane and the plane of the first mode-exciting element.

3. The antenna assembly of claim 1, further comprising:

a storage unit, a passband processor, and switching elements.

4. The antenna assembly of claim 1, further comprising a phase shifter.

5. The antenna assembly of claim 1, further comprising an adaptive matching circuit.

6. The antenna assembly of claim 1, where the carrying structure has a cubic shape.

7. The antenna assembly of claim 1, where the carrying structure is at least one a spherical, a hemispherical, a cylindrical, a semi-cylindrical, a circular, a half-circular, or a pyramidal shape.

8. The antenna assembly of claim 1, the antenna assembly being functionally associated with a MIMO (Multi-Input, Multi-Output), MISO (Multi-Input, Single-Output), SIMO (Single-Input, Multi-Output) or SISO (Single-Input, Single-Output) antenna system.

9. A communication device comprising:

a controller arrangement;

an adder/weight controller;

a sensor;

a demodulator; and an antenna arrangement including:

a carrying structure having a number of faces, each face having at least partly a ground plane and each face being provided with at least one dielectric resonator antenna (DRA) element; and a controller arrangement, a switching arrangement connected to each of the DRA elements, the controller arrangement to switch the antenna elements and alter at least one of frequency, polarization, or radiation pattern of each DRA element.

10. The device of claim 9, where the antenna element comprises:

a dielectric volume having a central axis normal to the ground plane; and a number of mode-exciting elements, including:

a first mode-exciting element provided in or attached to the dielectric volume and extending in a plane provided at a first distance from the central axis and being perpendicular to the ground plane, and a second mode-exciting element provided in or attached to the dielectric volume and extending in a plane provided at a second distance from the central axis and being perpendicular to both the ground plane and the plane of the first mode-exciting element; and a separate signal feeder for each mode-exciting element.

11. The communication device of claim 9, where the communication device comprises a cellular phone.

12. The communication device of claim 9, where the communication device comprises at least one of a base station, a wireless router/gateway, a communication card, a camera, a laptop, or a PDA.

13. A method of enhancing at least one diversity for weak S/N, strong fading, spatial division multiple access (SDMA) for multi-users, MIMO for data rate, strong S/N, strong fading, beam forming for weak S/N, weak fading, in a communication device, the method comprising:

using at least one dielectric resonator antenna (DRA) element on a carrying structure having a number of faces, each face having at least partly a ground plane and each face being provided with;

combining received or transmitted signals to a composite signal;

examining the composite signal; and based on said examination, by means of a controller arrangement and a switching arrangement connected to each of the DRA elements switching the antenna elements and altering one or several of frequency, polarization, or radiation pattern of each DRA element.

* * * * *